US011290812B2

(12) United States Patent
Laaksonen et al.

(10) Patent No.: US 11,290,812 B2
(45) Date of Patent: Mar. 29, 2022

(54) AUDIO DATA ARRANGEMENT

(71) Applicant: Nokia Technologies Oy, Espoo (FI)

(72) Inventors: Lasse Laaksonen, Tampere (FI); Arto Lehtiniemi, Lempaala (FI); Mikko Heikkinen, Tampere (FI); Toni Makinen, Pirkkala (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/962,534

(22) PCT Filed: Feb. 8, 2019

(86) PCT No.: PCT/IB2019/051040
§ 371 (c)(1),
(2) Date: Jul. 16, 2020

(87) PCT Pub. No.: WO2019/159050
PCT Pub. Date: Aug. 22, 2019

(65) Prior Publication Data

US 2020/0382864 A1 Dec. 3, 2020

(30) Foreign Application Priority Data

Feb. 19, 2018 (EP) ..... 18157327

(51) Int. Cl.
*H04R 3/00* (2006.01)
*H04S 7/00* (2006.01)

(52) U.S. Cl.
CPC ..... *H04R 3/005* (2013.01); *H04S 7/301* (2013.01); *H04R 2499/11* (2013.01); *H04S 2400/01* (2013.01); *H04S 2400/11* (2013.01); *H04S 2400/15* (2013.01)

(58) Field of Classification Search
CPC ..... G10K 11/17873; G10K 15/08; G10K 2210/1081; G10K 2210/3044; H04R 1/406; H04R 3/005; H04R 5/027; H04R 5/033; H04R 5/04; H04R 2420/07; H04R 2499/15; H04S 7/306; H04S 2400/15
USPC ..... 381/56, 58, 71.1, 71.2, 104, 124, 303, 381/311
See application file for complete search history.

(56) References Cited

U.S. PATENT DOCUMENTS

| | | | | |
|---|---|---|---|---|
| 8,525,868 | B2 | 9/2013 | Forutanpour et al. | 348/14.02 |
| 2008/0130918 | A1 | 6/2008 | Kimijima | 381/107 |
| 2010/0019715 | A1 | 1/2010 | Roe et al. | 318/568.12 |
| 2010/0195836 | A1 | 8/2010 | Platz | 381/26 |
| 2012/0330653 | A1* | 12/2012 | Lissek | H04R 1/406 704/226 |
| 2013/0342731 | A1* | 12/2013 | Lee | H04N 5/232127 348/231.4 |
| 2018/0270602 | A1* | 9/2018 | Laaksonen | H04S 7/303 |
| 2019/0088099 | A1* | 3/2019 | Garg | G06F 3/165 |

* cited by examiner

*Primary Examiner* — William A Jerez Lora
(74) *Attorney, Agent, or Firm* — Harrington & Smith

(57) ABSTRACT

A method, apparatus and computer readable medium is described in which audio data from multiple directions are received at a first user device (such as a mobile communication device). Instructions are received at the first user device from a remote device. An audio focus arrangement in the form of a direction-dependent amplification of the received audio data is generated. The audio focus arrangement is dependent on an orientation direction of the first user device and is modified in accordance with the instructions from the remote device.

20 Claims, 8 Drawing Sheets

AUDIO DATA ARRANGEMENT

CROSS REFERENCE TO RELATED APPLICATION

This patent application is a U.S. National Stage application of International Patent Application Number PCT/IB2019/051040 filed Feb. 8, 2019, which is hereby incorporated by reference in its entirety, and claims priority to EP 18157327.0 filed Feb. 19, 2018.

FIELD

This specification relates to receiving audio data from multiple directions using a user device.

BACKGROUND

When using a user device, such as a mobile communication device, to receive audio data regarding a scene, it is possible to move the user device such that different parts of the scene can be captured. An audio focus arrangement can be provided in which audio is boosted in the direction in which the user device is directed. This can lead to boosting of unwanted noise or to privacy concerns.

SUMMARY

In a first aspect, this specification describes a method comprising: receiving audio data from multiple directions at a first user device; receiving instructions at the first user device from a remote device; and generating an audio focus arrangement, wherein the audio focus arrangement is a direction-dependent amplification of the received audio data and wherein the audio focus arrangement is dependent on an orientation direction of the first user device and is modified in accordance with the instructions from the remote device. Modifying the audio focus arrangement may include one of: attenuating audio from a first direction; neither attenuating nor amplifying audio from the first direction; and amplifying audio from the first direction.

An audio output may be generated based on the received audio data and the generated audio focus arrangement.

The audio data may be amplified when the audio data is received from a direction within the audio focus arrangement.

The generated audio focus arrangement may include amplifying the audio data when the audio data is in the orientation direction of the user device, unless the instructions from the remote device instruct otherwise.

Modifying the audio focus arrangement may include modifying the audio focus arrangement in a direction of said remote device relative to the first user device. Alternatively, or in addition, modifying the audio focus arrangement may include modifying the audio focus arrangement in a direction indicated by the remote device.

The said instructions may be generated automatically by the remote device.

In some example embodiments, instructions may be received at the first user device from one or more further remote devices and the audio focus arrangement may be modified in accordance with the instructions from the one or more further remote devices.

In a second aspect, this specification describes an apparatus configured to perform any method as described with reference to the first aspect.

In a third aspect, this specification describes computer-readable instructions which, when executed by computing apparatus, cause the computing apparatus to perform any method as described with reference to the first aspect.

In a fourth aspect, this specification describes an apparatus comprising: means (such as one or more microphones) for receiving audio data from multiple directions; means (such as an input) for receiving instructions from a remote device; and means (such as a processor) for generating an audio focus arrangement, wherein the audio focus arrangement is a direction-dependent amplification of the received audio data and wherein the audio focus arrangement is dependent on an orientation direction of the apparatus and is modified in accordance with the instructions from the remote device.

The apparatus may further comprise means (such as an output) for providing an audio output based on the received audio data and the generated audio focus arrangement.

The means for generating the audio focus arrangement may be configured to modify the audio focus arrangement either in a direction of said remote device relative to the first user device and/or in a direction indicated by the remote device.

The audio focus arrangement may be configured to perform one or more of: attenuating audio from a first direction; neither attenuating nor amplifying audio from the first direction; and amplifying audio from the first direction.

The apparatus may be a mobile communication device.

In a fifth aspect, this specification describes an apparatus comprising: means for receiving audio data from multiple directions at a first user device; means for receiving instructions at the first user device from a remote device; and means for generating an audio focus arrangement, wherein the audio focus arrangement is a direction-dependent amplification of the received audio data and wherein the audio focus arrangement is dependent on an orientation direction of the first user device and is modified in accordance with the instructions from the remote device.

In a sixth aspect, this specification describes a computer readable medium comprising program instructions for causing an apparatus to perform at least the following: receive audio data from multiple directions at a first user device; receive instructions at the first user device from a remote device; and generate an audio focus arrangement, wherein the audio focus arrangement is a direction-dependent amplification of the received audio data and wherein the audio focus arrangement is dependent on an orientation direction of the first user device and is modified in accordance with the instructions from the remote device.

In a seventh aspect, this specification describes an apparatus comprising: at least one processor; at least one memory including computer program code which, when executed by the at least one processor, causes the apparatus to: receive audio data from multiple directions at a first user device; receive instructions at the first user device from a remote device; and generate an audio focus arrangement, wherein the audio focus arrangement is a direction-dependent amplification of the received audio data and wherein the audio focus arrangement is dependent on an orientation direction of the first user device and is modified in accordance with the instructions from the remote device.

In an eighth aspect, this specification describes a non-transitory computer readable medium comprising program instructions for causing an apparatus to perform at least the following: receive audio data from multiple directions at a first user device; receive instructions at the first user device from a remote device; and generate an audio focus arrangement, wherein the audio focus arrangement is a direction-dependent amplification of the received audio data and wherein the audio focus arrangement is dependent on an orientation direction of the first user device and is modified in accordance with the instructions from the remote device

BRIEF DESCRIPTION OF THE DRAWINGS

Example embodiments will now be described, by way of non-limiting examples, with reference to the following schematic drawings, in which.

DETAILED DESCRIPTION

Figure 1:
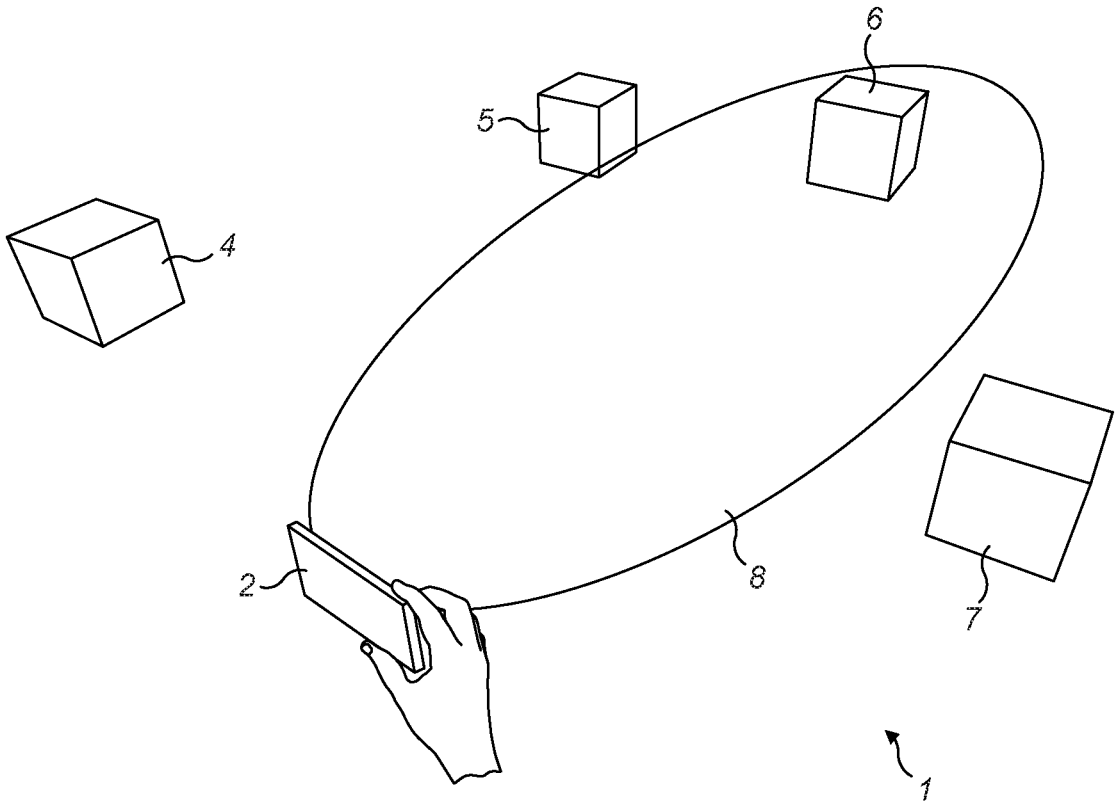
FIG. 1 is a block diagram of a system in accordance with an example embodiment.

FIG. 1 is a block diagram of a system, indicated generally by the reference numeral 1, in accordance with an example embodiment. The system 1 comprises a first user device 2 (such as a mobile communication device), which first user device may be a multi-microphone capture device, such as a mobile device, used to make video and audio recordings (with a camera of the first user device 2 being used to capture video data and one or more microphones being used to capture audio data). The system 1 also comprises a first audio source 4, a second audio source 5, a third audio source 6 and a fourth audio source 7. As shown in FIG. 1, the first user device 2 includes an audio focus beam 8. Audio data from within the audio focus beam 8 may be handled differently to audio data from outside the audio focus beam. For example, audio data within the audio focus beam may be amplified, whereas audio data outside the audio focus beam may not be amplified or may be attenuated.

As described further below, the audio focus beam 8 is typically used to amplify audio recorded in a direction of orientation of the first user device 2. By way of example, in the example system 1, the audio focus beam is directed towards the third audio source 6. Thus, for example, the first user device 2 can be moved to capture audio and video in different directions, with the audio being amplified in the direction in which the video images are being taken at the time. Moreover, in some example embodiments, video and audio data may be captured in different directions (providing, in effect, different video and audio focus beams).

Figure 2A:
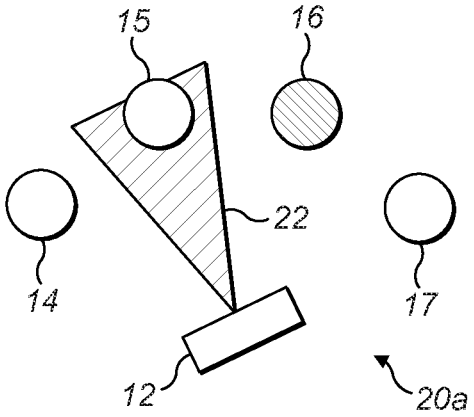
FIGS. 2*a* and 2*b* are block diagrams of a system in accordance with an example embodiment.
Figure 2B:
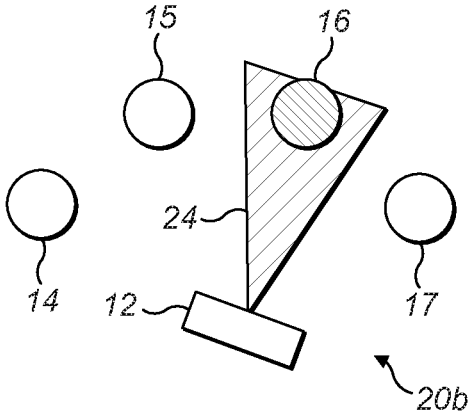

FIGS. 2*a* and 2*b* are highly schematic block diagrams of a system, indicated generally by the reference numerals 20*a* and 20*b* respectively, in accordance with an example embodiment. The systems 20*a* and 20*b* comprise a first user device 12 and first to fourth audio sources 14 to 17. The first user device 12 may be the same as the user device 2 described above with reference to FIG. 1.

In the system 20*a*, the first user device 12 is directed towards the second audio object 15. As shown in FIG. 2*a*, the system 20*a* includes an audio focus beam 22 that is centred on the second audio object 15. Similarly, in the system 20*b*, the first user device is directed towards the third audio object 16. As shown in FIG. 3*b*, the system 20*b* includes an audio focus beam 24 that is centred on the third audio object 16.

Consider the following arrangement in which the third source 16 is a source of potentially disturbing sounds. By way of example, consider a children's party in which the first, second, third and fourth objects represent children at the party. Assume that the third object 16 represents a child who is crying. Consider now a scenario in which the user device 12 is being used to take a video and audio recording of the birthday party by sweeping the video recording across the audio objects (for example, from being focused on the second object 15 as shown in FIG. 2*a* to being focused on the third object 16 as shown in FIG. 2*b*). When the first user device 12 is directed towards the third object 16 (as shown in FIG. 2*b*), the audio focus arrangement described above with will amplify the audio from the crying child. (Note that the terms "amplify" and "boost" are used interchangeably in this document.) It may therefore be undesirable to implement the audio focus arrangement described above with reference to the system 1.

Figure 3:
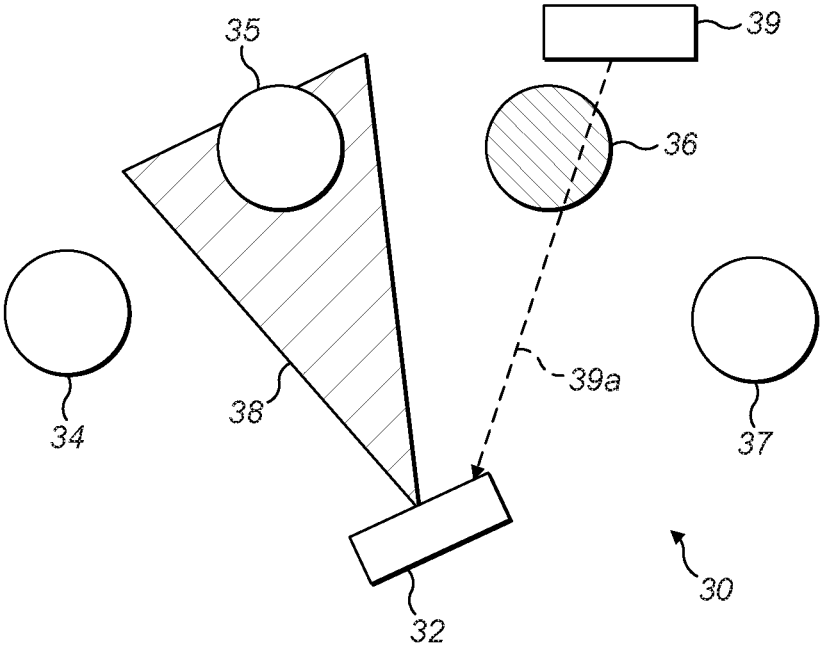
FIG. 3 is a block diagram of a system in accordance with an example embodiment.

FIG. 3 is a block diagram of a system, indicated generally by the reference numeral 30, in accordance with an example embodiment. The system 30 includes a first user device 32 (similar to the user device 12 described above) and first to fourth audio objects 34 to 37 (similar to the audio objects 14 to 17 described above). As shown in FIG. 3, the user device 32 is directed towards the second audio object 35, such that an audio focus beam 38 is directed towards the second audio object.

The system 30 also includes a second user device 39 (such as a mobile communication device) that may be similar to the first user device 32 described above. The second user device 39 is at or near the third audio object 36. The second user device 39 sends a message (labelled 39*a* in FIG. 4) to the first user device 32 requesting that the normal audio focus arrangement be suspended in the direction of the second user device 39. Thus, as described in detail below, the message 39*a* sent from the second user device 39 to the first user device 32 may be used to prevent the audio focus arrangement described above from being applied in the direction of the noisy third audio object 36.

The message 39*a* may take many forms. By way of example, the message 39*a* may make use of local communication protocols, such as Bluetooth® to transmit messages to other user devices (such as the first user device 32) in the vicinity of the second user device 39. The skilled person will be aware of many other suitable message formats.

It should be noted that the width of the audio focus beam 38 in the system 30 (and the width of comparable audio focus beams in other embodiments) may be a definable parameter and may, for example, be set by a second user device 39. Alternatively, that parameter could be pre-set or set in some other way.

Figure 4:
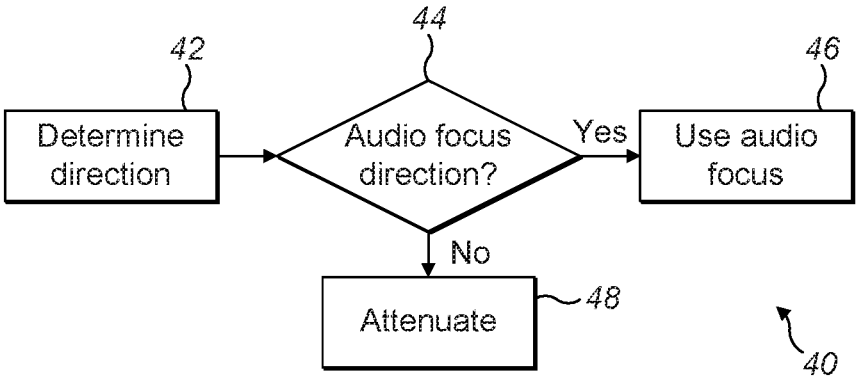
FIG. 4 is a flow chart showing an algorithm in accordance with an example embodiment.

FIG. 4 is a flow chart showing an algorithm, indicated generally by the reference numeral 40, in accordance with an example embodiment. The algorithm 40 starts at operation 42, where the focus direction of the first user device 32 is determined. Next, at operation 44, it is determined whether the focus direction is an audio focus direction. In one embodiment, the direction identified in operation 42 is an audio focus direction unless a user device (such as the second user device 39) has requested that audio focus not be applied in the relevant direction. The focus direction determined at operation 42 may be a camera focus direction of the user device 32, but this is not essential to all embodiments. For example, the focus direction may be an audio focus direction of the user device 32 (regardless of the existence or direction of a camera focus direction).

In the event that the direction determined in operation 42 is an audio focus direction, then the algorithm 40 moves to operation 46, where the normal audio focus is used, such that audio in the relevant direction captured by the user device 32 is amplified. If the direction determined in operation 42 is not an audio focus direction, then the algorithm moves to operation 48, where the captured audio in the relevant direction is attenuated (or, in some embodiments, not amplified).

The message 39*a* described above may be sent from the second user device 39 to the first user device 32 in a number of ways. For example, the user of the device 39 (such as a parent of the child that forms the audio object 36) may select an 'unhear me' option on the second user device 39, which causes the message 39*a* to be output using the Bluetooth® standard, or some other messaging scheme. The skilled person will be aware of many other suitable mechanisms for sending such a message.

Many mechanisms exist for implementing the audio focus arrangement described above. Different arrangements are described below, by way of example, with references to FIGS. 5 to 7.

Figure 5A:
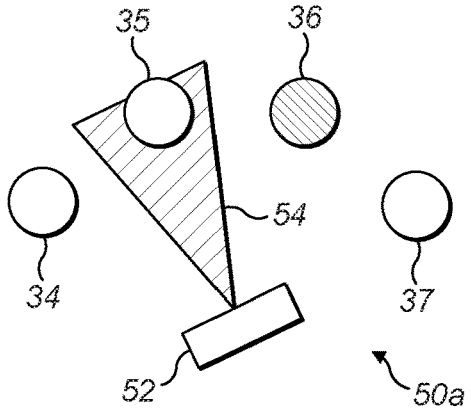
FIGS. 5*a*, 5*b* and 5*c* are block diagrams of a system in accordance with an example embodiment.
Figure 5B:
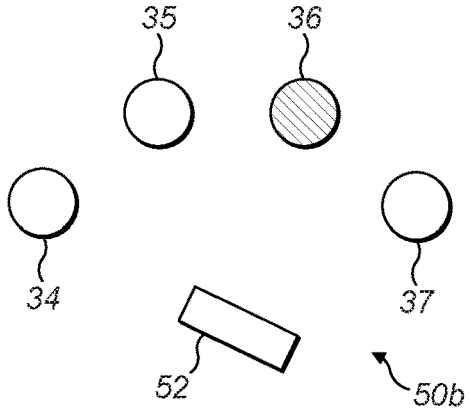
Figure 5C:
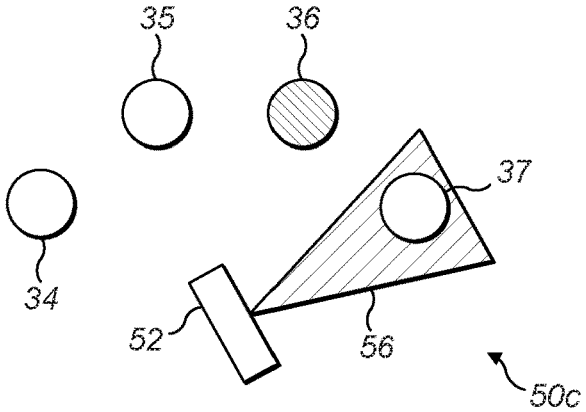

FIGS. 5*a*, 5*b* and 5*c* are block diagrams of a system, indicated generally by the reference numerals 50*a*, 50*b* and 50*c* respectively, in accordance with an example embodiment.

The systems 50*a*, 50*b* and 50*c* include the first to fourth audio objects 34 to 37 described above and also include a user device 52 (similar to the user devices 2, 12 and 32 described above). In FIGS. 5*a* to 5*c*, the user device 52 is shown performing a sweep such that the user device is directed towards the second object 35 (FIG. 5*a*), the third object 36 (FIG. 5*b*) and the fourth object 37 (FIG. 5*c*) in turn.

Assume that the third object 36 is deemed to be a noisy object. Thus, when the user device 52 is directed towards the third object 36, the operation 44 in the algorithm 40 is answered in the negative (such that the algorithm 40 moves to operation 48). When the user device 52 is directed in any other direction, then the operation 44 is answered in the positive (such that the algorithm 40 moves to operation 46).

When the user device 52 is directed towards the second audio object 35 (as shown in FIG. 5*a*), the user device 52 is directed in an audio focus direction. Operation 46 of the algorithm 40 is implemented by the provision of an audio focus beam 54 that is centred on the second audio object 35, such that audio from the second audio object is amplified.

When the user device 52 is directed towards the third audio object 36 (as shown in FIG. 5*b*), the user device 52 is not directed in an audio focus direction. Operation 48 of the algorithm 40 is implemented by not providing an audio focus beam, such that audio from the third audio object is not boosted. In an alternative embodiment, the audio from the third audio object 36 may be attenuated (rather than simply not being boosted as indicated in FIG. 5*b*).

When the user device 52 is directed towards the fourth audio object 37 (as shown in FIG. 5*c*), the user device 52 is directed in an audio focus direction. Operation 46 of the algorithm 40 is implemented by the provision of an audio focus beam 56 that is centred on the fourth audio object 37, such that audio from the fourth audio object is amplified.

It can be seen in FIGS. 5*a* to 5*c* that audio from the first, second and fourth objects 34, 35 and 37 can be amplified when those objects are within the focus of the user device, but that the noisy third object 36 (a crying child in the example given above) is either not boosted or is attenuated when in the focus of the user device. In this way, it is possible to control the user device such that the impact of unwanted noise on the recorded scene can be reduced. The algorithm 40 may enable the user device to be controlled to achieve this effect without requiring a user of that user device to change user device settings at the same time as capturing the audio (and possibly also visual) data.

There are many alternatives to the arrangement described above with reference to FIGS. 5*a* to 5*c*. By way of example, FIGS. 6*a*, 6*b*, 6*c* and 6*d* are block diagrams of a system, indicated generally by the reference numerals 60*a*, 60*b*, 60*c* and 60*d* respectively, in accordance with an example embodiment.

The systems 60*a*, 60*b*, 60*c* and 60*d* include the first to fourth audio objects 34 to 37 described above and also include a user device 62 (similar to the user devices 2, 12, 32 and 52 described above). In FIGS. 6*a* to 6*d*, the user device 62 is shown performing a sweep such that the user device is successively directed towards the second object 35 (FIG. 6*a*), between the second and third objects (FIG. 6*b*), between the third and fourth objects (FIG. 6*c*) and towards the fourth object 37 (FIG. 6*d*).

Assume, once again, that the third object 36 is deemed to be a noisy object. Thus, when the user device 62 is directed towards the third object 36, the operation 44 in the algorithm 40 is answered in the negative (such that the algorithm 40 moves to operation 48). When the user device 62 is directed in any other direction, then the operation 44 is answered in the positive (such that the algorithm 40 moves to operation 46).

Figure 6A:
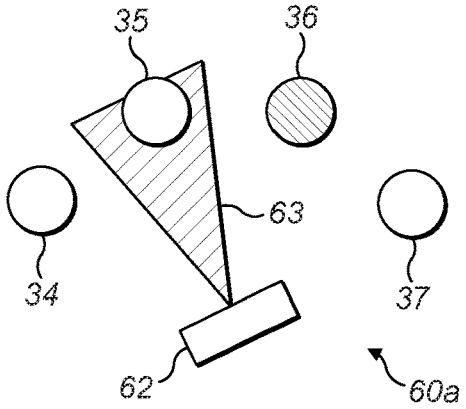
FIGS. 6*a*, 6*b*, 6*c* and 6*d* are block diagrams of a system in accordance with an example embodiment.

When the user device 62 is directed towards the second audio object 35 (as shown in FIG. 6*a*), the user device 62 is directed in an audio focus direction. Operation 46 of the algorithm 40 is implemented by the provision of an audio focus beam 63 that is centred on the second audio object 35, such that audio from the second audio object is amplified.

Figure 6B:
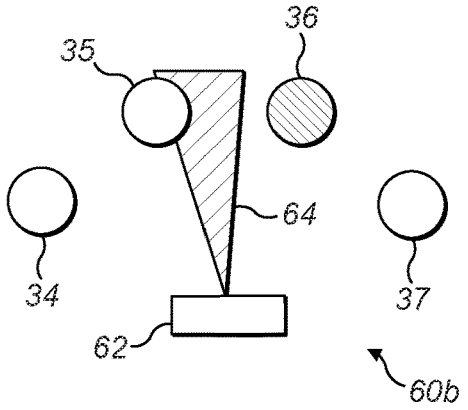

When the user device 62 is directed between the second object 35 and the third object 36 (as shown in FIG. 6*b*), part of the user device 62 is directed in an audio focus direction and part is not. As shown in FIG. 6*b*, an audio focus beam 64 is provided for the area that is in an audio focus direction. Thus, the audio focus beam 64 is narrower than the audio focus beam 63.

Figure 6C:
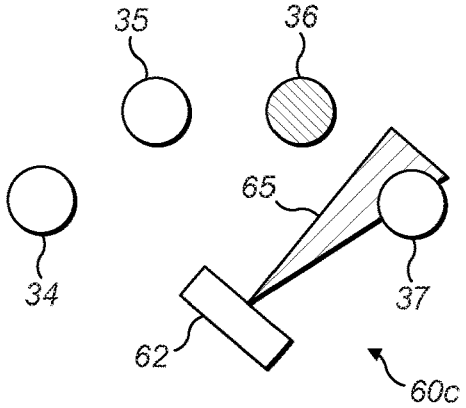
Figure 6D:
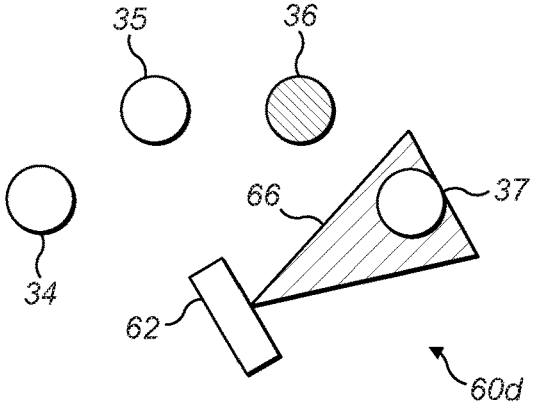

When the user device 62 is directed between the third object 36 and the fourth object 37 (as shown in FIG. 6*c*), part of the user device 62 is directed in an audio focus direction and part is not. As shown in FIG. 6*c*, an audio focus beam 65 is provided for the area that is in an audio focus direction. Thus, the audio focus beam 65 is narrower than the audio focus beam 63.

When the user device 62 is directed towards the fourth audio object 47 (as shown in FIG. 6*d*), the user device 62 is directed in an audio focus direction. Operation 46 of the algorithm 40 is implemented by the provision of an audio focus beam 66 that is centred on the fourth audio object 37, such that audio from the fourth audio object is amplified.

As described above with reference to FIG. 5*b*, when the relevant user device (e.g. the user device 52) is directed towards a noisy object (e.g. the object 36), the audio focus beam may be disabled entirely. A similar arrangement may be provided in the system 60*a* to 60*d* described above. This is not essential to in all embodiments.

Figure 7:
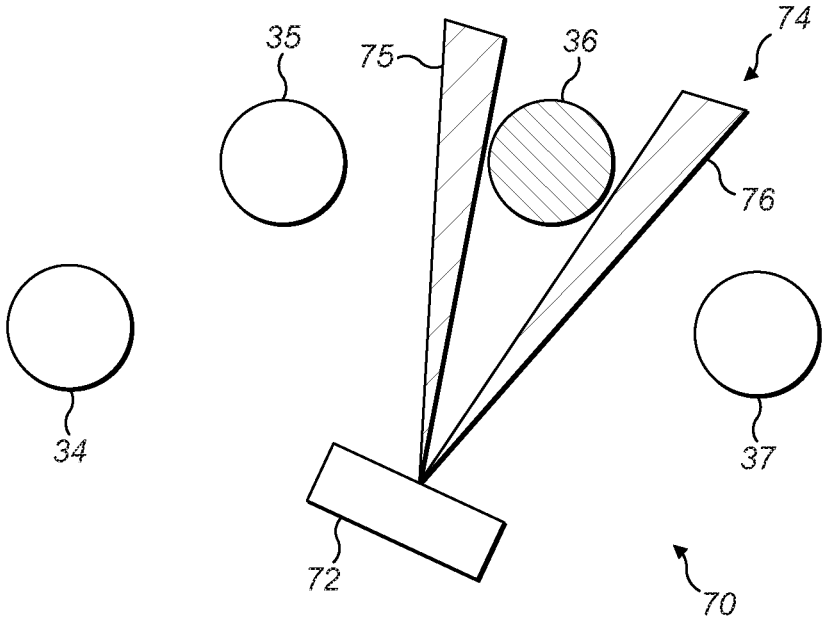
FIG. 7 is a block diagram of a system in accordance with an example embodiment.

FIG. 7 is a block diagram of a system, indicated generally by the reference numeral 70, in accordance with an example embodiment.

The system 70 includes the first to fourth audio objects 34 to 37 described above and also include a user device 72 (similar to the user devices 2, 12, 32, 52 and 62 described above). In FIG. 7, the user device 72 is shown directed towards the third object 36.

Assume that the third object 36 is deemed to be a noisy object. Thus, when the user device 72 is directed towards the third object 36, the operation 44 in the algorithm 40 is answered in the negative (such that the algorithm 40 moves to operation 48). When the user device 72 is directed in any other direction, then the operation 44 is answered in the positive (such that the algorithm 40 moves to operation 46).

In the system 70, there is no audio focus beam directed towards the third object 36, but audio focus regions 75 and 76 are shown either side of the third object 36. (This can be considered to be an audio focus beam 74 with the portion directed towards the third object 36 omitted.) Thus, audio from all directions other than the direction of the object 36 can be boosted. It should be noted that the width of the portion missing from the audio focus beam 74 could be a definable parameter and may, for example, be set by a remote device (such as the remote device 39 described above). Alternatively, that parameter could be pre-set.

As described above with reference to FIG. 3, the system 30 includes a second user device 39 (such as a mobile communication device) that is used to send a message (labelled 39*a* in FIG. 4) to the first user device 32 requesting that the normal audio focus arrangement be suspended in the direction of the second user device 39. A similar arrangement may be provided in any of the systems 50, 60 or 70 described above.

Figure 8:
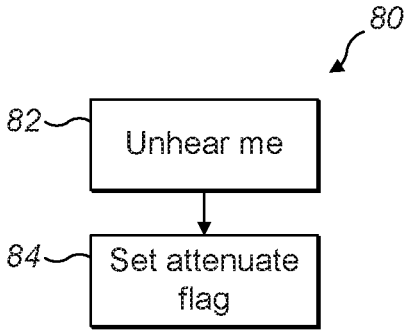
FIGS. 8 and 9 are flow charts showing algorithms in accordance with example embodiments.

FIG. 8 is a flow chart showing an algorithm, indicated generally by the reference numeral 80, in accordance with an example embodiment. The algorithm 80 starts at operation 82 where a second user device (such as the user device 39 described above) sends an 'unhear me' message to the first user device (such as any of the user devices 2, 12, 32, 52, 62, 72 described above). In response to the message received in operation 82, an attenuate (or similar) flag is set in operation 84.

The attenuate flag 84 may be associated with the direction of the user device 39 such that operation 44 of the algorithm 40 can be implemented by determining whether an attenuate flag has been set for the direction identified in operation 42. Of course, this functionality could be implemented in many different ways. In particular, not all embodiments include an attenuation—in many examples described herein unamplified directions are neither amplified nor attenuated.

Figure 9:
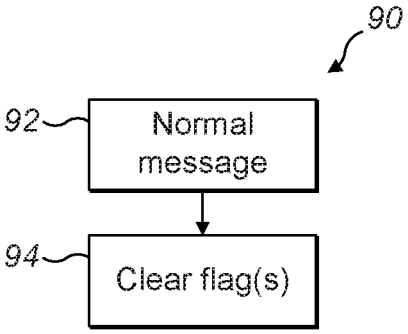

FIG. 9 is a flow chart showing an algorithm, indicated generally by the reference numeral 90, in accordance with an example embodiment. The algorithm 90 starts at operation 92 where a second user device (such as the user device 39 described above) sends a 'normal' message to the first user device (such as the any of the user devices 2, 12, 32, 52, 62, 72 described above). In response to the message received in operation 92, an attenuate (or similar) flag is cleared in operation 94.

The second user device may take many forms. For example, the second user device could be a mobile communication device, such as a mobile phone. However, this is not essential to all embodiments. For example, the second user device may be a wearable device, such as a watch or a fitness monitor.

The principles described herein are not restricted to dealing with issues of noise. For example, the 'unhear me' arrangement may be used for privacy purposes. For example, a person may be having a conversation that is not related to a scene being captured by the first user device 2, 12, 32, 52, 62, 72. The 'unhear me' setting described herein can be used to attenuate (or at least not amplify) such a conversation. By way of example, a user may receive a telephone call on a user device (such as the second user device 39). In order to keep that telephone call private, the user may make use of the 'unhear me' feature described herein to prevent sounds from that call being captured by the first user device.

In some example embodiments, a mobile device receiving or initiating a telephone call will indicate an 'unhear me' control message to all nearby mobile devices. In such an embodiment, the 'unhear me' control message may be output automatically by the mobile device when a telephone call is received or initiated.

The embodiments described above relate to controlling the use of an audio focus arrangement of a user device when capturing audio data. It is also possible to use the principles described herein to modify an audio focus arrangement in different ways.

Figure 10:
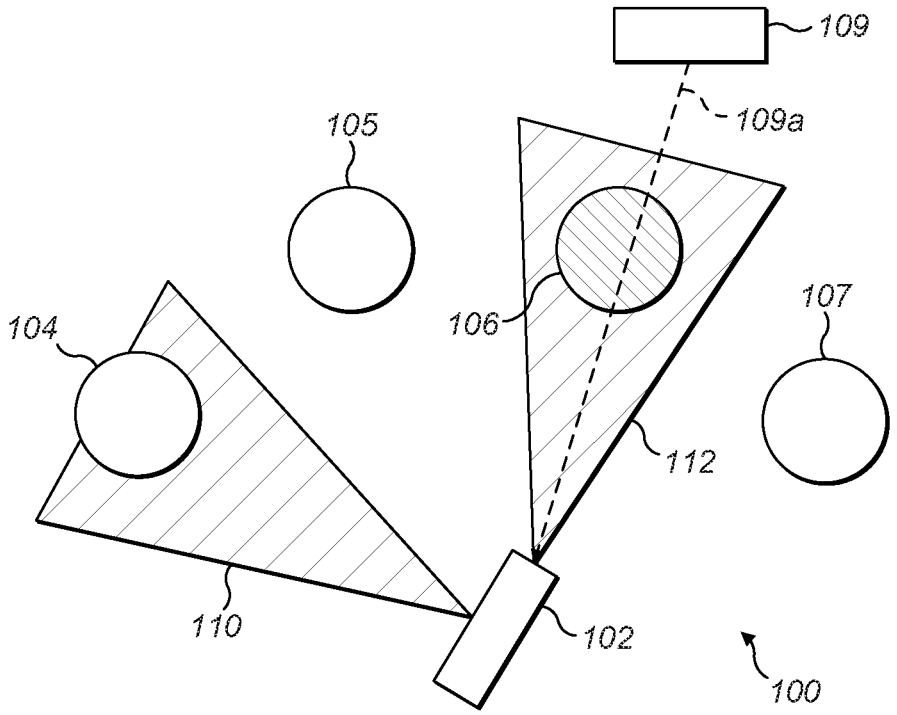
FIG. 10 is a block diagram of a system in accordance with an example embodiment.

FIG. 10 is a block diagram of a system, indicated generally by the reference numeral 100, in accordance with an example embodiment. The system 100 includes a first user device 102 (similar to the user devices 2, 12, 34, 56, 62 and 72 described above) and the first to fourth audio objects 104 to 107 (similar to the audio objects 14 and 34, 15 and 35, 16 and 36, and 17 and 37 respectively, as described above). As shown in FIG. 10, the first user device 102 is directed towards the first audio object 104, such that a first audio focus beam 110 is directed towards the first audio object.

As described above, the first audio focus beam 110 is typically used to amplify audio in a direction of orientation of the first user device 102. Thus, for example, the first user device 102 can be moved to capture audio and video in different directions, with the audio being amplified in the direction in which the video images are being taken at the time.

The system 100 also includes a second user device 109 (similar to the user device 39 described above). The second user device 109 is at or near the third audio object 106. The second user device 109 sends a message (labelled 109*a* in FIG. 10) to the first user device 102. As described further below, the second user device 109 can be used to instruct the first user device 102 to boost audio coming from the direction of the second user device. Thus, as shown in FIG. 10, a second audio focus beam 112 is shown that is directed towards the second user device 109 (and hence towards the third audio object 106).

Figure 11:
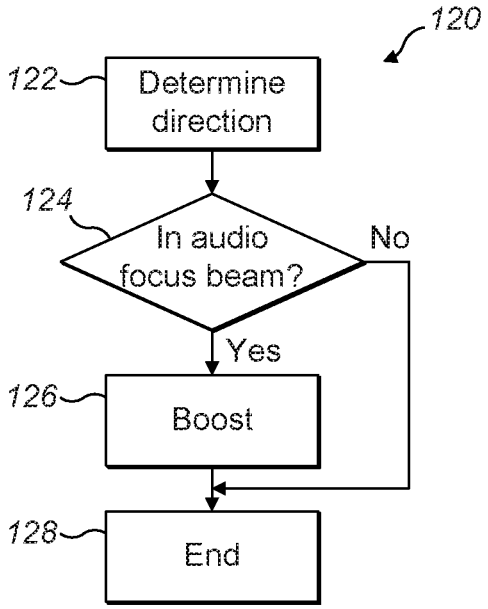
FIGS. 11 to 13 are flow charts showing algorithms in accordance with example embodiments.

FIG. 11 is a flow chart showing an algorithm, indicated generally by the reference numeral 120, in accordance with an example embodiment. The algorithm 120 starts at operation 122, where the direction from which audio detected in the system 100 is determined. Next, at operation 124, it is determined whether the direction determined in operation 122 is within an audio focus beam (e.g. the first audio focus beam 110 or the second audio focus beam 112 described above). If the direction determined in operation 122 is within an audio focus beam, the algorithm moves to operation 126, where the relevant audio is amplified, before terminating at operation 128. Otherwise, the algorithm terminates at operation 128 without implementing the amplification operation 126.

The message 109*a* described above may be sent from the second user device 109 to the first user device 102 in a number of ways. For example, the user of the device 109 (such as a parent of the child that forms the audio object 36) may select an 'hear me' option on the second user device 109, which causes the message 109*a* to be output using the Bluetooth® standard, or some other messaging scheme. The skilled person will be aware of many other suitable mechanisms for sending such a message.

Figure 12:
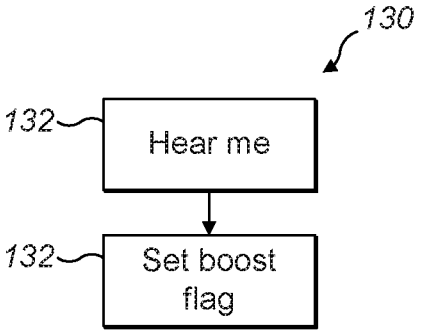

FIG. 12 is a flow chart showing an algorithm, indicated generally by the reference numeral 130, in accordance with an example embodiment. The algorithm 130 starts at operation 132 where a second user device (such as the user device 109 described above) sends a 'hear me' message to the first user device (such as the first user device 102). In response to the message received in operation 132, a boost (or similar) flag is set in operation 134.

The boost flag 134 may be associated with the direction of the second user device 109 such that audio data received at the first user device 102 in the direction indicated in the boost flag is boosted. The boost flag may therefore be used in the operation 124 of the algorithm 120 described above. Of course, this functionality could be implemented in many different ways.

In the algorithms 80, 90 and 130 described above, the direction of the second user device relative to the first user device is deemed to be the relevant direction for the instruction. This is not essential to all embodiments. For example, the message sent by the second user device 39 or 109 may include direction, location or some other data, such that the second user device 39 or 109 can be used to modify the audio amplification functionality of the first user device in some other direction. For example, in the example system 30 described above with reference to FIG. 3, the second user device 39 may send a message 39*a* to the first user device 32 that the second object 35 is a noisy object. Thus, the operation 44 would be answered in the negative when the first user device 32 is directed towards the second object 35. In another example, in the example system 100 described above with reference to FIG. 10, the second user device 109 may send a message 109*a* to the first user device 102 that the fourth object 107 should be amplified such that audio coming from the fourth user device 107 would be identified in operation 124 and amplified in operation 126.

The algorithm 40 described above may be extended such that multiple areas are defined for which the audio should be attenuated (or at least not amplified). Similarly, the algorithm 120 may be extended such that multiple area are defined for which audio should be amplified. Furthermore, the algorithms 40 and 120 described above may be combined such one or more areas may be defined for which audio should be attenuated (or at least not amplified) and one or more areas may be defined for which audio should be boosted.

Many implementations of the principles described herein are possible. By way of example, a first user may use a first user device (such as any one of the user devices 2, 12, 32, 52, 62, 72 or 102) to obtain audio data (and optionally also video images). At the same time, a second user may use a second user device (such as the user device 39 or 109) to define audio boosting and/or audio attenuation areas within a defined space (such audio boosting and/or audio attenuation being the boosting or attenuation of the audio content captured by the first user device).

In this way, the first user can concentrate on capturing the audio data (and, optionally, video data), whilst the second user can concentrate on the appropriate audio requirements (such as attenuating audio in the direction of a crying child or boosting audio in the direction of someone giving a speech). Returning to example of a children's party, the second user may define zones in which audio focus should not be applied (e.g. due to one or more noisy or crying children) and/or may define one or more zones, other than the orientation direction of the first user device, in which audio focus should be applied (e.g. the direction from which a parent is singing to the children at the party).

In some implementations, a user may make use of a remote device (such as the second user device 39 or 109) to indicate a noise source. This is not essential. For example, an audio analysis engine may be used to automatically detect noise sources. For example, such an audio analysis engine may analyse the content of its closest sounds sources and compare the obtained pattern to a database of noise sources and at least one threshold level. This may allow for automatic creation and sending of messages such as the 'unhear me' message 82 discussed above.

Figure 13:
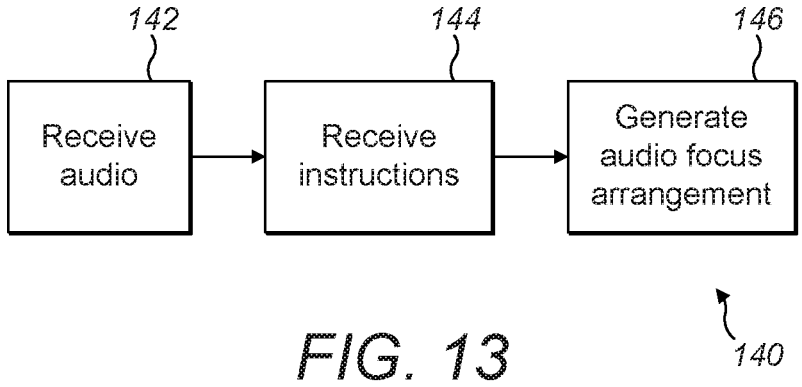

FIG. 13 is a flow chart showing an algorithm, indicated generally by the reference numeral 140, in accordance with an example embodiment. The algorithm 140 starts at operation 142, where audio data is received at a first user device. The audio data may be obtained from multiple directions. At operation 144, instructions are received at the first user device, for example from one or more remote device (e.g. the second user devices 39 or 109 described above). At operation 146, an audio focus arrangement is generated. For example, the audio focus arrangement may be dependent on an orientation direction of the first user device and may be modified in accordance with the instructions from the remote device.

At least some of the embodiments described herein may make use of spatial audio techniques in which an array of microphones is used to capture a sound scene and subjected to parametric spatial audio processing so that, during rendering, sounds are presented so that sounds are heard as if coming from directions around the user that match video recordings. Such techniques are known, for example, in virtual reality or augmented reality applications. Such spatial audio processing may involve estimating the directional portion of the sound scene and the ambient portion of the sound scene.

Figure 14:
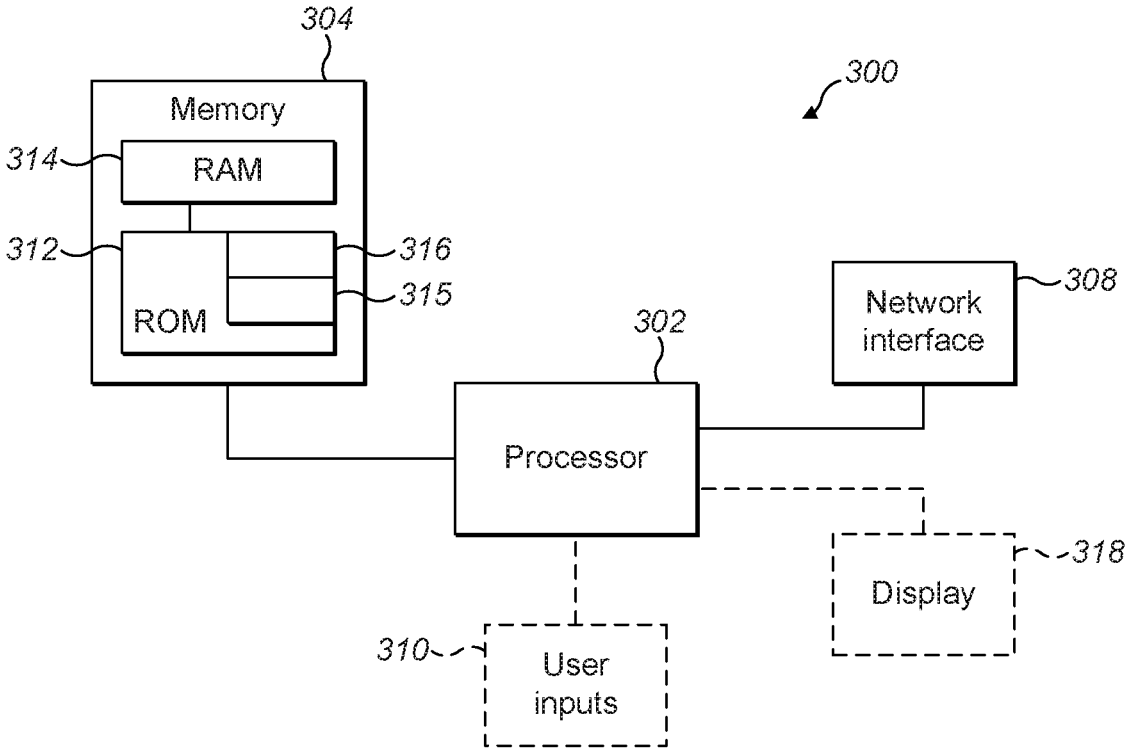
FIG. 14 is a block diagram of components of a processing system in accordance with an exemplary embodiment.

For completeness, FIG. 14 is a schematic diagram of components of one or more of the modules described previously (e.g. implementing some or all of the operations of the algorithms 80 and 120 described above), which hereafter are referred to generically as processing systems 300. A processing system 300 may have a processor 302, a memory 304 closely coupled to the processor and comprised of a RAM 314 and ROM 312, and, optionally, user input 310 and a display 318. The processing system 300 may comprise one or more network interfaces 308 for connection to a network, e.g. a modem which may be wired or wireless.

The processor 302 is connected to each of the other components in order to control operation thereof.

The memory 304 may comprise a non-volatile memory, such as a hard disk drive (HDD) or a solid state drive (SSD). The ROM 312 of the memory 304 stores, amongst other things, an operating system 315 and may store software applications 316. The RAM 314 of the memory 304 is used by the processor 302 for the temporary storage of data. The operating system 315 may contain code which, when executed by the processor implements aspects of the algorithms 40, 80, 90, 120, 130 and 140 described above.

The processor 302 may take any suitable form. For instance, it may be a microcontroller, plural microcontrollers, a processor, or plural processors.

The processing system 300 may be a standalone computer, a server, a console, or a network thereof.

In some embodiments, the processing system 300 may also be associated with external software applications. These may be applications stored on a remote server device and may run partly or exclusively on the remote server device. These applications may be termed cloud-hosted applications. The processing system 300 may be in communication with the remote server device in order to utilize the software application stored there.

Figure 15A:
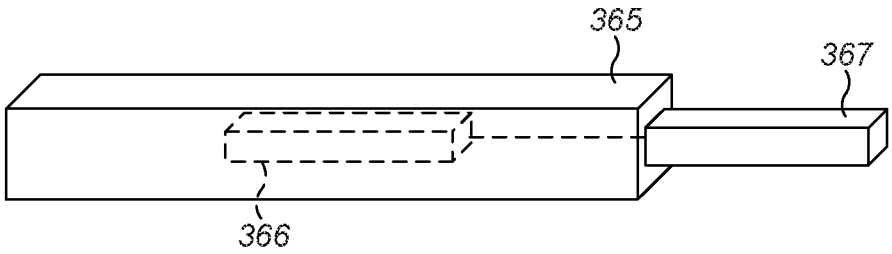
FIGS. 15*a* and 15*b* show tangible media, respectively a removable memory unit and a compact disc (CD) storing computer-readable code which when run by a computer perform operations according to embodiments.
Figure 15B:
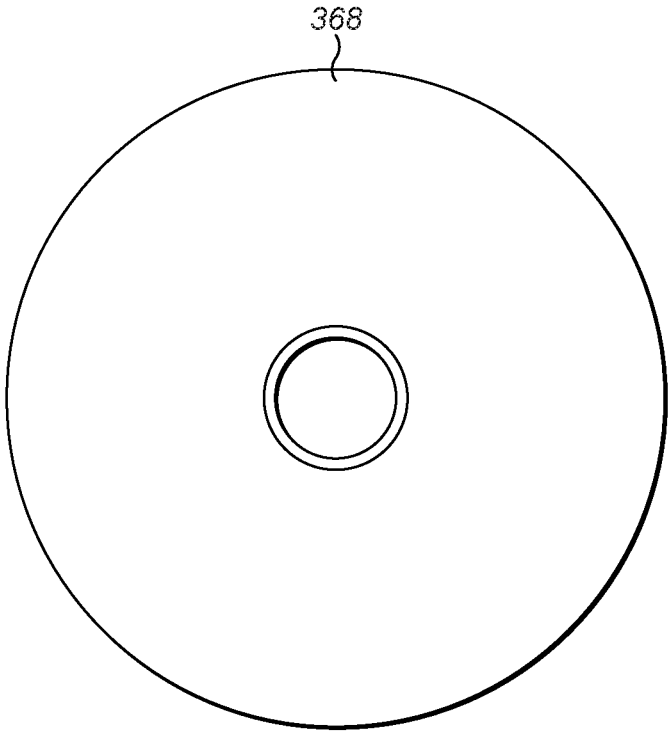

FIGS. 15*a* and 15*b* show tangible media, respectively a removable memory unit 365 and a compact disc (CD) 368, storing computer-readable code which when run by a computer may perform methods according to embodiments described above. The removable memory unit 365 may be a memory stick, e.g. a USB memory stick, having internal memory 366 storing the computer-readable code. The memory 366 may be accessed by a computer system via a connector 367. The CD 368 may be a CD-ROM or a DVD or similar. Other forms of tangible storage media may be used.

Embodiments of the present invention may be implemented in software, hardware, application logic or a combination of software, hardware and application logic. The software, application logic and/or hardware may reside on memory, or any computer media. In an example embodiment, the application logic, software or an instruction set is maintained on any one of various conventional computer-readable media. In the context of this document, a "memory" or "computer-readable medium" may be any non-transitory media or means that can contain, store, communicate, propagate or transport the instructions for use by or in connection with an instruction execution system, apparatus, or device, such as a computer.

Reference to, where relevant, "computer-readable storage medium", "computer program product", "tangibly embodied computer program" etc., or a "processor" or "processing circuitry" etc. should be understood to encompass not only computers having differing architectures such as single/multi-processor architectures and sequencers/parallel architectures, but also specialised circuits such as field programmable gate arrays FPGA, application specify circuits ASIC, signal processing devices and other devices. References to computer program, instructions, code etc. should be understood to express software for a programmable processor firmware such as the programmable content of a hardware device as instructions for a processor or configured or configuration settings for a fixed function device, gate array, programmable logic device, etc.

As used in this application, the term "circuitry" refers to all of the following: (a) hardware-only circuit implementations (such as implementations in only analogue and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a server, to perform various functions) and (c) to circuits, such as a microprocessor(s) or a portion of a microprocessor(s), that require software or firmware for operation, even if the software or firmware is not physically present.

If desired, the different functions discussed herein may be performed in a different order and/or concurrently with each other. Furthermore, if desired, one or more of the above-described functions may be optional or may be combined. Similarly, it will also be appreciated that the flow diagrams of FIGS. 4, 8, 9, 11, 12 and 13 are examples only and that various operations depicted therein may be omitted, reordered and/or combined.

It will be appreciated that the above described example embodiments are purely illustrative and are not limiting on the scope of the invention. Other variations and modifications will be apparent to persons skilled in the art upon reading the present specification.

Moreover, the disclosure of the present application should be understood to include any novel features or any novel combination of features either explicitly or implicitly disclosed herein or any generalization thereof and during the prosecution of the present application or of any application derived therefrom, new claims may be formulated to cover any such features and/or combination of such features.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes various examples, these descriptions should not be viewed in a limiting sense. Rather, there are several variations and modifications which may be made without departing from the scope of the present invention as defined in the appended claims.

The invention claimed is:

1. An apparatus comprising at least one processor and at least one non-transitory memory including computer program code which, when executed with the at least one processor, causes the apparatus to:

receive audio data from multiple directions at a first user device;

receive instructions at the first user device from a remote device, wherein the instructions are configured to prevent application of an audio focus arrangement in an indicated direction; and generate the audio focus arrangement, wherein the audio focus arrangement is a direction-dependent amplification of the received audio data and wherein the audio focus arrangement is dependent on an orientation direction of the first user device and is modified in accordance with the instructions from the remote device.

2. The apparatus of claim 1, wherein the at least one memory further includes computer program code which, when executed with the at least one processor, causes the apparatus to: generate an audio output based on the received audio data and the generated audio focus arrangement.

3. The apparatus of claim 1, wherein the at least one memory further includes computer program code which, when executed with the at least one processor, causes the apparatus to: amplify the audio data when the audio data is received from a direction within the audio focus arrangement.

4. The apparatus of claim 1, wherein the generated audio focus arrangement includes amplifying the audio data when the audio data is in the orientation direction of the user device and the instructions from the remote device do not instruct otherwise.

5. The apparatus of claim 1, wherein modifying the audio focus arrangement includes modifying the audio focus arrangement in a direction of said remote device relative to the first user device.

6. The apparatus of claim 1, wherein modifying the audio focus arrangement includes modifying the audio focus arrangement in the indicated direction with the remote device to at least one of:

be attenuated, or not be amplified when the indicated direction at least partially overlaps with the orientation direction.

7. The apparatus of claim 1, wherein modifying the audio focus arrangement includes one of:

attenuating audio from a first direction;

neither attenuating nor amplifying the audio from the first direction; or amplifying the audio from the first direction.

8. The apparatus of claim 7, wherein the at least one memory further includes computer program code which, when executed with the at least one processor, causes the apparatus to: amplify the audio from the first direction when said instructions from said remote device comprise amplify instructions.

9. The apparatus of claim 7, wherein the at least one memory further includes computer program code which, when executed with the at least one processor, causes the apparatus to: attenuate the audio from the first direction when said instructions from said remote device comprise attenuate instructions.

10. The apparatus of claim 9, wherein the attenuate instructions are based on a message sent from the remote device when a telephone call is initiated or received at the remote device.

11. The apparatus of claim 7, wherein the at least one memory further includes computer program code which, when executed with the at least one processor, causes the apparatus to: neither attenuate nor amplify the audio from the first direction when said instructions include clearing instructions to clear any previous amplify instructions or attenuate instructions.

12. The apparatus of any one claim 1, wherein the instructions are generated automatically with the remote device.

13. The apparatus of claim 1, wherein the at least one memory further includes computer program code which, when executed with the at least one processor, causes the apparatus to:

receive instructions at the first user device from one or more further remote devices; and modify the audio focus arrangement in accordance with the instructions from the one or more further remote devices.

14. An apparatus as claimed in claim 1, wherein the apparatus is a mobile communication device.

15. A method comprising:

receiving audio data from multiple directions at a first user device;

receiving instructions at the first user device from a remote device, wherein the instructions are configured to prevent application of an audio focus arrangement in an indicated direction; and generating the audio focus arrangement, wherein the audio focus arrangement is a direction-dependent amplification of the received audio data and wherein the audio focus arrangement is dependent on an orientation direction of the first user device and is modified in accordance with the instructions from the remote device.

16. A method as claimed in claim 15, further comprising generating an audio output based on the received audio data and the generated audio focus arrangement.

17. A method as claimed in claim 15, wherein modifying the audio focus arrangement includes modifying the audio focus arrangement in a direction of the remote device relative to the first user device.

18. A method as claimed in claim 15, wherein modifying the audio focus arrangement includes one of:

attenuating audio from a first direction;

neither attenuating nor amplifying the audio from the first direction; or amplifying the audio from the first direction.

19. A method as claimed in claim 15, further comprising:

receiving instructions at the first user device from one or more further remote devices; and modifying the audio focus arrangement in accordance with the instructions from the one or more further remote devices.

20. A computer readable medium comprising program instructions for causing an apparatus to perform at least the following:

receive audio data from multiple directions at a first user device;

receive instructions at the first user device from a remote device, wherein the instructions are configured to prevent application of an audio focus arrangement in an indicated direction; and generate the audio focus arrangement, wherein the audio focus arrangement is a direction-dependent amplification of the received audio data and wherein the audio focus arrangement is dependent on an orientation direction of the first user device and is modified in accordance with the instructions from the remote device.

* * * * *